United States Patent [19]

Grimm

[11] 4,145,654

[45] Mar. 20, 1979

[54] THERMAL SWITCH

[75] Inventor: Forrest R. Grimm, Golden Valley, Minn.

[73] Assignee: Minnesota Mining and Manufacturing Company, Saint Paul, Minn.

[21] Appl. No.: 817,552

[22] Filed: Jul. 21, 1977

[51] Int. Cl.[2] ..... H01H 37/76

[52] U.S. Cl. ..... 337/407; 337/403

[58] Field of Search ..... 337/407, 408, 403, 401

[56] References Cited

U.S. PATENT DOCUMENTS

| | | | |
|---|---|---|---|
| 2,318,607 | 5/1943 | Grant, Jr. | 337/407 |
| 3,291,945 | 12/1966 | Merill et al. | 337/407 |
| 3,956,725 | 5/1976 | Merill et al. | 337/407 |

*Primary Examiner*—Harold Broome

*Attorney, Agent, or Firm*—Cruzan Alexander; Donald M. Sell; Terryl K. Qualey

[57] ABSTRACT

A switch device utilizing independently acting biasing members to position a conductor to close a circuit between a pair of leads and maintain such closed circuit until a switch activating member such as a meltable pellet reaches a circuit opening state whereupon further independent biasing action causes the conductor member to assume a circuit open position.

4 Claims, 12 Drawing Figures

THERMAL SWITCH

BACKGROUND OF THE INVENTION

1. Field of the Invention

This invention relates to a switching device.

2. Description of the Prior Art.

Switching devices, particularly thermally actuatable switches, have gained widespread use in numerous applications to prevent appliances, electrical and electronic equipment from generating unsafe temperatures. In general, such switches employ a conductive bar or bridge member which is releasably positioned to close and open a circuit between two leads. Positioning of the conductive bar is accomplished by means of springs responsive to the state or condition of a temperature sensitive member, typically a pellet of material which shrinks in size or melts at a given temperature. So long as the pellet is in a particular state or condition, the circuit between the leads via the conductor is closed. When the pellet reaches another predetermined state or condition, generally melting of the pellet, the conductive bar is released from contact with the leads and the circuit is opened. Release of the bar is effected by actuation of springs or the like which are responsive to the condition or state of the pellet. One such thermal cut-off device is described in U.S. Pat. No. 3,952,274. Such device utilizes a conductive spring blade operatively connected to one of two leads. The spring blade is normally biased away from the other lead. This normal bias is overcome by a biasing member which engages a temperature sensitive pellet. If the pellet shrinks or melts, the force exerted by the biasing member is insufficient to overcome the biasing force of the spring blade. Consequently, the spring blade moves away from the other lead opening the circuit. It can be seen that such a device relies upon a pair of springs which act directly and oppositely on each other. This requires selecting springs which will cooperatively exert the requisite forces at each stage or condition of the temperature sensitive pellet. U.S. Pat. No. 3,956,725 describes a similar thermal cut-off switch utilizing a combination of cooperatively opposing spring members to position a conductor in open and closed circuit relationship to a pair of leads.

SUMMARY

The temperature sensitive pellets employed in such thermal cut-off switches are selected on the basis of their melting point or range. The switch is located in thermally conductive proximity to an element whose temperature is to be monitored. Melting of the pellet is the circuit opening triggering event. However, the material of which the pellet is made may shrink due to sublimation or for some other reason, in which case the effect of the pellet on one or more of the springs involved in positioning the circuit completing conductive bar may be changed. Depending upon the degree of shrinkage and the relationship of the springs, the circuit may be opened although the melting temperature of the pellet has not been reached. It is thus desirable to provide a circuit opening mechanism which will accommodate some shrinkage in the pellet, but beyond that will provide for opening of the circuit. Other features desirable in a thermal cut-off switch of the type herein described are simplicity of design, fail-safe capabilities, compactness and convenient insertion into the electrical circuitry at a locality thermally proximate to the element or area to be monitored.

It is an object of this invention to provide a thermal cut-off switch in which opening and closing of the circuit is accomplished by independently acting members. A further object is the provision of such a switch providing a degree of accommodation for shrinkage of the temperature sensitive element. A still further object is the provision of a thermal cut-off switch which is compact, simple in design, has fail-safe features and is conveniently attachable to a variety of surfaces.

These and other objects are provided by a switch comprising a housing providing a cavity, at least two lead means extending into said cavity, electrical conductor means for selectively completing an electrical circuit between said lead means, a switch activating member, first and second biasing means, and isolating means for isolating said first biasing means from said second biasing means, said device having a circuit completing state wherein said switch activating member is in a first state and said first biasing means acting independent of said second biasing means exerts a force on said electrical conductor to complete said circuit, and a circuit opening state wherein said switch activating member is in a second state and said second biasing means acting independent of said first biasing means exerts a force on said electrical conductor to open said circuit.

In preferred embodiments, the switch-activating member is a pellet of material meltable or softenable at a given temperature or within a given range generally substantially above room temperature. The first and second biasing means are springs which are operationally isolated from each other so as to operate independent of each other. While the switch activating member is in its circuit closing state, the first biasing means (spring) acts solely on the conductor means. When the pellet reaches the circuit breaking state, the first spring is neutralized so to speak and the second biasing means urges the conductor away from the leads, breaking the electrical circuit. The isolating means is preferably a frame member having opposing ends, one of which rests atop the pellet and the other of which is engaged by the second biasing means. The first biasing means as well as the conductor means are preferably confined within the isolating means. When the pellet reaches the circuit opening state, the action of the first spring is neutralized and the second spring alone exerts a force which moves the conductor means to a position whereby the circuit is broken. Drawings are provided wherein:

DESCRIPTION OF THE PREFERRED EMBODIMENTS

Figure 1:
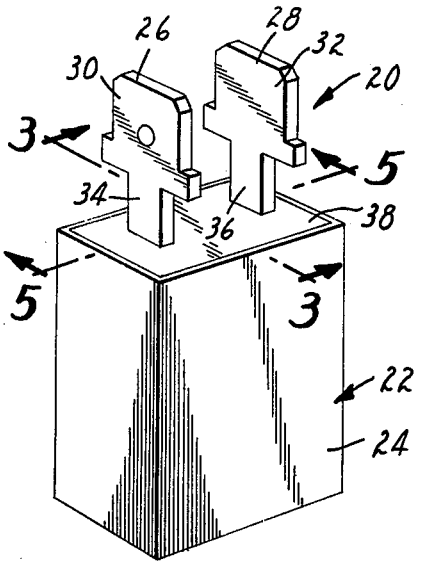
FIG. 1 is a perspective view of a preferred embodiment of the invention.

Referring to FIG. 1, the device 20 includes a case 22 defining a main body portion 24. Case 22 is preferably constructed of a thermally and electrically conductive material, e.g., a metal such as aluminum of a zinc alloy.

A pair of parallel leads 26 and 28 including spade terminals 30 and 32 and a portion of posts 34 and 36 respectively, extend from end 38 of the main body portion 24. End 38 is provided by an electrically insulating potting compound which together with case 22 preferably completely encases the remaining elements of the device 20.

Figure 2:
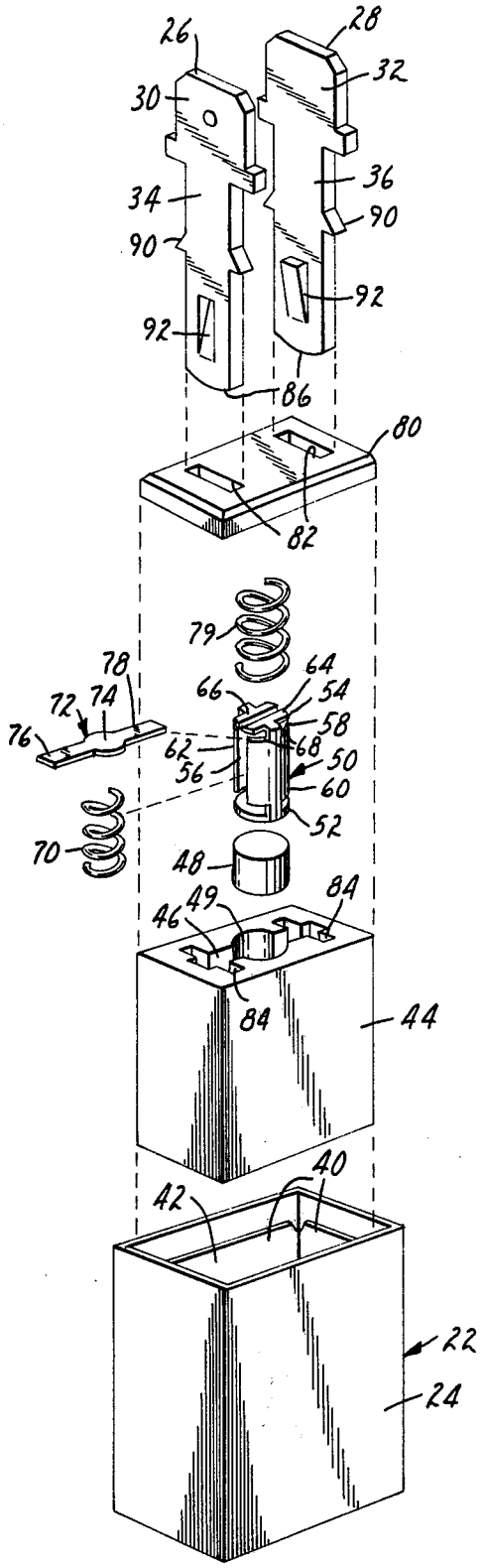
FIG. 2 is an exploded view of the various elements of the embodiment depicted in FIG. 1.

In FIG. 2, from bottom to top, the case 22, having peripheral retaining tabs 40, defines a cavity 42. An insert 44 nests in cavity 42. Insert 44, which is made of a rigid, electrical insulating material, is provided with a recess 46 shaped to receive and retain the various operating elements of the device in electrical isolation from case 22 (except for the temperature sensitive pellet). Cylindrical-shaped pellet 48 is slidably fitted in a central, longitudinally extending channel 49 of recess 46. Disposed above pellet 48 is a cylindrical-shaped member 50 having opposing, generally flat, parallel ends 52 and 54. When in position, end 52 engages the proximate end of pellet 48. Member 50 is provided with opposing, longitudinally extending slots 56 and 58 defined by opposing sidewalls 60 and 62. End 54 of member 50 is formed by crimping T-shaped tabs 64 and 66. In doing so, transverse slots 68 are provided between end 54 and sidewalls 60 and 62. A compression spring 70 of suitable dimensions is positioned within member 50. Between spring 70 and end 54 is located conductor bar 72 having a central, circular-shaped section 74 from which extends opposing rectangular-shaped sections 76 and 78. Conductor bar 72 is dimensioned such that it is slidably retained within member 50, the central section 74 being confined laterally within walls 60 and 62 and longitudinally between ends 52 and 54.

Sections 76 and 78 extend through and are slidable along slots 56 and 58. Spring 70 urges conductor bar 72 upwardly towards end 54 of member 50. A second compression spring 79 is positioned above member 50, and exerts a downward biasing force against end 54 of member 50. An insulating plate 80 preferably of ceramic composition, dimensioned to fit atop insert 44 and confine spring 79 in recess 46 is provided with parallel slots 82 which communicate with slots 84 of recess 46 in insert 44. Posts 34 and 36 are dimensioned for slidable insertion through slots 82 and 84 into the interior of recess 46. Plate 80 is optionally fitted with a central downward directed nipple 85 (see FIG. 3) which aids in positioning and retaining spring 79 in place. Ends 86 of posts 34 and 36 are preferably slightly curved for reasons mentioned hereinafter. Intermediate each of the ends 86 and the shoulders of terminals 30 and 32 are opposing angular projections 90 which serve to securely mount and orient leads 26 and 28 in recess 46. Between projections 90 and ends 86 are spring tabs 92 which upon insertion of leads 26 and 28 are depressed so as to be flush with the sides of posts 34 and 36. After the posts 34 and 36 are inserted into recess 46 the desired distance (i.e., through insulating plate 80), the spring tabs 92 are freed from lateral constraints and extend laterally inwardly from posts 34 and 36 due to their normal biasing action to lock leads 26 and 28 in place.

Figure 3:
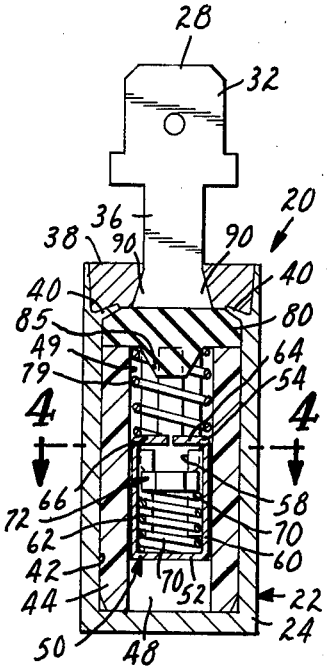
FIG. 3 is a sectional view taken along line 3—3 of the embodiment of FIG. 1.

In FIG. 3, the various elements depicted in FIG. 2 are shown in location. Mounted longitudinally at the extreme lower end of channel 49 is pellet 48. End 52 of member 50 rests atop and in engagement with pellet 48. Spring 70 is in a compressed or loaded state, being confined between conductor bar 72 and end 52 of member 50. Conductor bar 72 is held in position spaced from end 54 of member 50 by means of ends 86 of leads 26 and 28 which press against sections 76 and 78 of conductor bar 72. The space between end 54 and conductor bar 72 is determined by the height of pellet 48 and the distance leads 26 and 28 extend into recess 46. Except for pellet 48, insert 44 and plate 80 electrically insulate the elements positioned in recess 46 from case 22.

Figure 4:
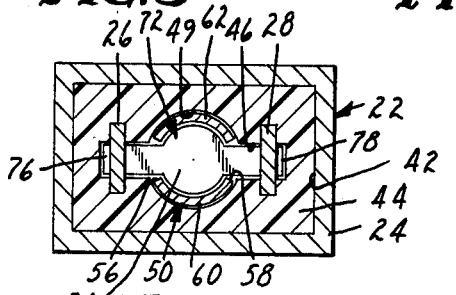
FIG. 4 is a sectional view taken along line 4—4 of FIG. 3.

As seen in FIG. 4, leads 26 and 28 contact conductor bar 72 proximate the ends 76 and 78, respectively.

Figure 5:
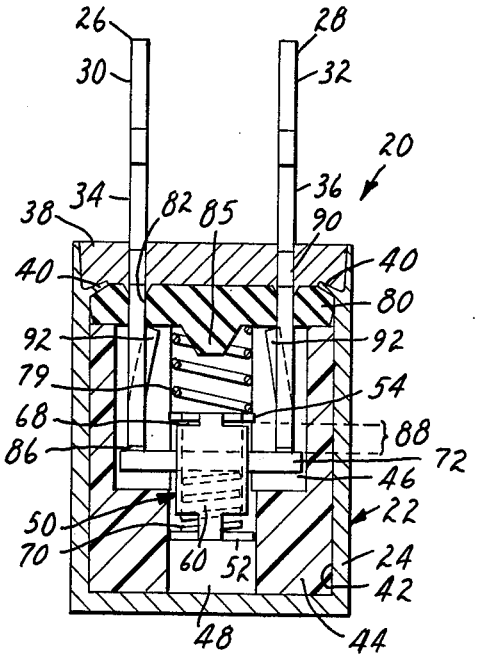
FIG. 5 is a sectional view taken along line 5—5 of the embodiment of FIG. 1 with the elements shown in an initial circuit completing state.
Figure 6:
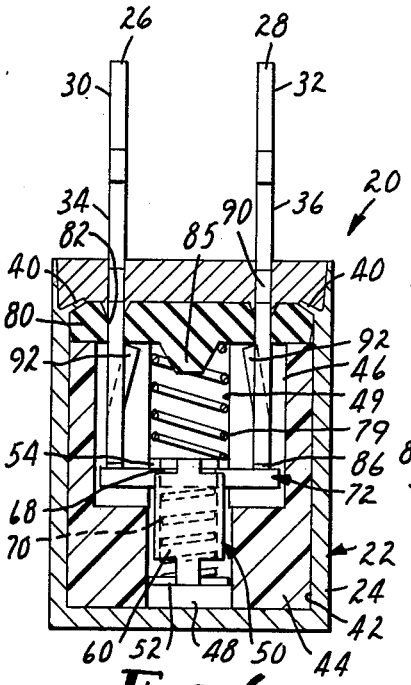
FIGS. 6 and 7 are sectional views similar to FIG. 5 in different, later stages of operation.
Figure 7:
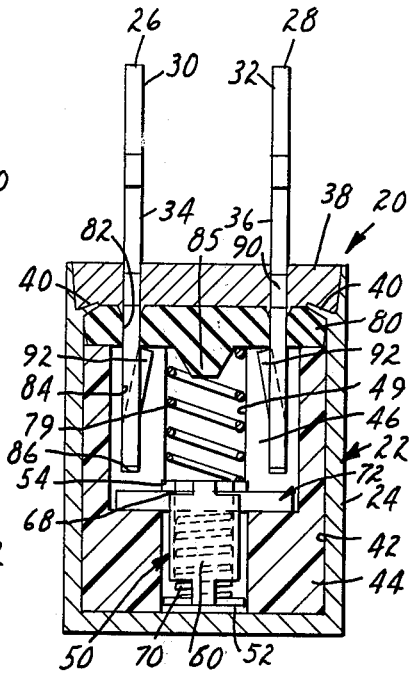

FIGS. 5, 6, and 7 depict the preferred embodiment in three stages of operation. In FIG. 5, pellet 48 is shown in its circuit completing state, that is, it is in solid form and occupies such a depth of channel 49 that conductor bar 72 is urged against ends 86 of leads 26 and 28 to provide a completed circuit between such leads. As noted above, ends 86 of leads 26 and 28 have a slight convex curvature. This shape affords a better electrical contact between ends 86 and bar 72 than would be achieved if ends 86 were entirely flat. The dimensions of the channel 49, member 50, leads 26 and 28 and pellet 48 are such that bar 72 is spaced from end 54 of member 50 a predetermined distance designated by the numeral 88 in FIG. 5.

In FIG. 6, Pellet 48 has decreased in length an amount equal to the distance 88. This shortening of pellet 48 may be due to sublimation over a period of time. End 52 of member 50 remains engaged with pellet 48 due to the action of spring 79. The net result is that the bottom of end 54 moves into engagement with conductor bar 72. It can now be seen that spring 70 has reached its neutralized (yet not unloaded) state with respect to bar 72 and that any further reduction in the depth of channel 49 occupied by pellet 48 or a reduction in the force exerted by pellet 48 on member 50 such as if pellet 48 were to soften substantially or melt would result in further downward movement of member 50 and initial downward movment of confined bar 72. Thus, in FIG. 6, pellet 48 is at the limit of its circuit completing state.

In FIG. 7, pellet 48 has undergone a change in state (e.g., further shrinkage due to sublimation, or melting), and is now in what may be termed a circuit opening or breaking state. Spring 79 continues to urge member 50 downwardly and consequently also bar 72. The electrical contact with leads 26 and 28 is broken and the circuit opens. It is noteworthy that electrical contact is broken at both leads 26 and 28. This is desirable since welding of one of the leads to the conductor bar will not prevent the circuit from being broken.

Figure 8:
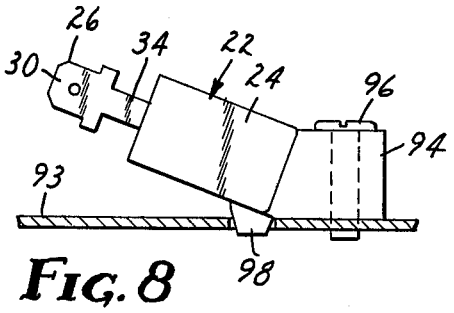
FIG. 8 is a side elevation view illustrating mounting of the embodiment of FIG. 1.

FIG. 8 illustrates mounting of device 20 to a plate 93. Extending from the main body portion 24 of case 22 is a mounting plate 94 bored to receive a screw 96 or similar mounting means. Forward of mounting plate 94 and extending angularly from body portion 24 is an orientation tab 98 which is inserted in an opening in plate 93. Main body portion 24 is thus upwardly angularly disposed with respect to plate 93, so that terminals 30 and 32 are completely clear of plate 93 to minimize the chances of shorting out the device at the terminal connection.

Figure 9:
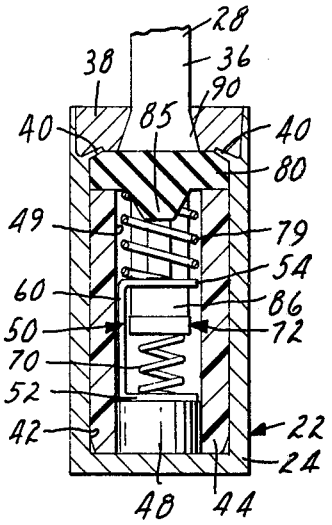
FIG. 9 is a longitudinal sectional view of another embodiment of the invention.

FIG. 9 illustrates another embodiment with like elements to those of the device of FIGS. 1–8 being given like numerals. The embodiment of FIG. 9 utilizes essentially the same elements of the preferred embodiment except that member 50 has only one sidewall 60.

Figure 10:
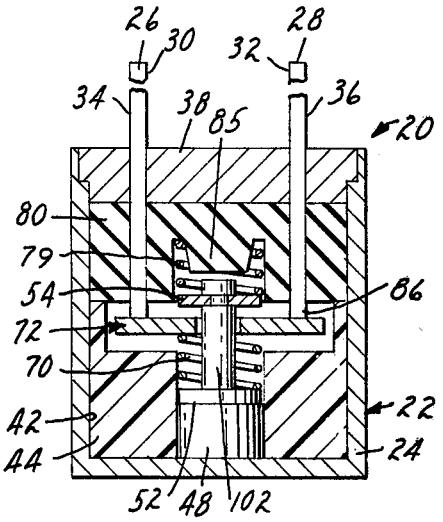
FIG. 10 is a longitudinal section of still another embodiment of the invention.

The embodiment of FIG. 10 (with like elements being given like numerals) differs from the previous embodiments in that the functional equivalent of member 50 is central, longitudinal extending post 102 surrounding which is spring 70.

Figure 11:
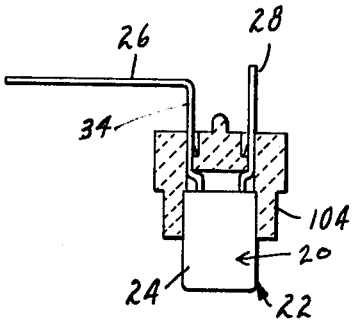
FIG. 11 is a side elevation view with some parts shown in section of the device of this invention in combination with an insulator element.

FIG. 11 illustrates the device 20 inserted in mounting insulator 104. Lead 26 has a right-angle bend in post 34.

Figure 12:
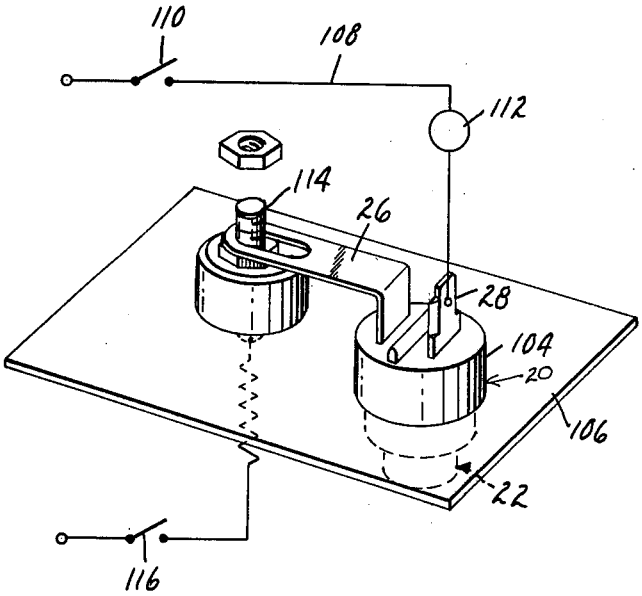
FIG. 12 is an isometric view of an embodiment of the invention mounted and schematically depicted in an electrical circuit.

In FIG. 12, the device 20 is shown as part of an electrical circuit. Device 20, inserted in mounting insulator 104, is in turn, mounted on plate 106. A circuit 108 is provided including switch 110, thermostat 112, conductor pin 114 and switch 116. With switches 110 and 116 closed the circuit 108 is complete so long as the pellet 48 is in a circuit completing state. When pellet 48 converts to a circuit opening state such as by melting or shrinking in dimension beyond a predetermined amount, conductor bar 72 is urged away from mutual electrical contact with leads 26 and 28 and the circuit is broken.

The device of this invention is primarily intended to serve as a thermal cut-off switch. It is mounted in thermally conductive proximity to the element or environment to be monitored. Generally, the device is mounted to a thermally and electrically conductive surface, although it may be mounted to electrical insulating surfaces such as ceramics or other organic or inorganic insulating materials.

The pellet 48 may be made of any material responsive to the condition to be monitored. Suitable temperature-sensitive pellets are disclosed in U.S. Pat. Nos. 3,180,958, 3,291,945, and 3,519,972. Preferably, the pellet should have a reasonably sharp melting point and be electrically nonconductive. While melting of the pellet is the normal circuit breaking event, the composition of the pellet may be subject to shrinkage due to sublimation or other causes. The device of this invention is designed to compensate for such shrinkage, typically by as much as 50% of the initial length of the pellet.

The significant feature of this invention is the independent operation of the springs 70 and 79 which allows both higher electrical contact forces and higher separation forces as a result of the nonopposing relationship of the springs. The pellet 48, which is in axial alignment with member 50 and springs 70 and 79, acts via member 50 as a reaction member for both springs 70 and 79.

In a typical application, for a pellet having an initial height of 0.25 cm., spring 70 will exert a force of approximately two pounds. Upon the pellet reaching its circuit opening state, spring 79, acting upon end 54 of member 50 (as well as the now upwardly confined conductor bar 72), exerts a sufficient force to break contact with the leads. Since spring 70 has been neutralized at this point with respect to conductor bar 72, the force exerted by spring 79 is essentially the only force applied to conductor bar 72. Thus, spring 79 may have an intrinsic force rating greater than, equal to, or less than the intrinsic force rating of spring 70. Generally, spring 79 has a rating greater than spring 70, however, on the order of 2 to 4 pounds.

As noted above, at least certain pellet compositions may be subject to shrinkage due to sublimation or the like. The device of this invention is preferably substantially gas tight, owing to the combination of case 22 and the potting compound forming end 38. The potting compound is poured into the cavity 42 after the device has been assembled. Epoxy resins represent a preferred potting compound. A potting compound should be selected which will not require temperatures for pouring and hardening which will interfere with operation of the device, particularly melting of the temperature-sensitive pellet. The insert 44 serves to limit travel of the conductor bar 72 and member 50 which, in the fully tripped position (pellet 48 being in the circuit opening state), has a clearance of approximately 0.04 cm. from the base of case 22.

The design parameters which determine the size of the device of the invention include the desired contact force exerted by the spring 79 over a selected working range for pellet length variation, desired circuit opening force at minimum pellet working length, adequate gap between parts in the tripped or circuit opening position, and thicknesses for the various insulators and metal case. Since the pellet is generally allowed a shrink factor of 50%, the spring rate for spring 79 is the factor that determines how the spring force varies over an allowable length variation of 0.050 inch. The lower the spring rate, the more constant is the force. However, to achieve low spring rates, it is necessary to have a larger number of coils which greatly increases the length of the springs. Therefore, the desired spring characteristics of force and rate have the most influence on the size of the device. A high contact force for spring 70, e.g., one which varies from 2 pounds at initial pellet length to 1.3 pounds at 50% of initial length, insures low electrical resistance throughout the life of the device. A relatively high trip force exerted by spring 79 increases device reliability through the ability to separate contacts which may have become cold welded over a long period of time.

The leads are supported and electrically insulated from the conductive case by insulator plate 80. Shoulders on the portion of the lead that passes through the insulator plate prevent inward movement when the lead is subjected to a pushing force. A pulling force is resisted by tabs 92 protruding from the side of the terminal. Tabs 92, which bear against the internal surface of the insulator plate 80, act as a leaf spring and deflect to a flush position as the leads pass through the rectangular-shaped slots 82 in the insulator plate 80. The leads shown in the drawings are standard 0.625 cm. blade type leads, although other lead configurations having crimp, screw, solder, or weld terminations can easily be installed.

The case is extended a distance of 0.2 cm. beyond the external surface of the insulator plate 80 so as to form a well for the containment of the potting material while it hardens. This simplifies the potting operation and provides a thick section of potting material for increased gas tightness. Although the case is electrically insulated from the leads and mechanism by the two insulators 44 and 80, the pellet is in intimate contact with the case. This permits efficient heat transfer from the case to the pellet.

Assembly of the device of this invention is readily apparent from FIG. 2. Member 50 is initially open at end 54. Spring 70 is positioned inside member 50 followed by placing conductor bar 72 in member 50 atop spring 70. Conductor bar 72 is pushed downwardly against spring 70. End 54 of member 50, which initially is in the form of opposing flaps, is formed by bending the flaps down and towards one another. Insert 44 is then dropped into case 22. Pellet 48 is then lowered into recess 46, followed by the member 50 subassembly. Spring 79 is then positioned in recess 46, followed by insulator plate 80. Insulator plate 80 is secured in place by bending tabs 40 into engagement with the chamferred edges of plate 80. Leads 26 and 28 are pushed through slots 82 of plate 80 until the projections 90 on posts 34 and 36 are seated against the upper surface of plate 80. The cavity between the plate 80 and the plane between opposing upper edges of case 22 is then filled with a suitable potting compound.

The spring system of this invention provides a highly reliable, low cost thermal cut-off device. With high contact forces and trip forces, expensive plating on parts can be minimized, eliminated entirely, or replaced by lower cost plating materials. Design of the device is simplified in that the springs do not have to be carefully matched and, therefore, can be sized independently. Ample trip force can be designed into the trip spring (spring 79) to guard against the possibility of welded contacts. Member 50, with its hollow cage-like design, is one means of isolating springs 70 and 79 so that the force of trip spring 79 on conductor bar 72 is bypassed until the time of actuation. FIGS. 9 and 10 illustrate additional embodiments. A single pellet-supporting both aligned springs as provided by the present invention represents a simple, reliable approach to operation of a thermal cut-off device.

What is claimed is:

1. A thermal switch comprising:

a housing providing a cavity, a pair of spaced electrical leads extending into said cavity in parallel through one end of said housing, a conductor bar within said cavity for contacting the ends of said leads, to make electrical connection therebetween, a mechanical isolating member surrounding said conductor bar between said leads and having parallel ends perpendicular to said leads, said conductor bar being movable within said isolating member between said parallel ends thereof and said isolating member being movable in said cavity parallel to said electrical leads, a first compression spring within said isolating member urging said conductor bar toward the end of said isolating member nearest said one end of said cavity, a second compression spring between said one end of said cavity and said isolating member urging said isolating member toward the end of said cavity opposite said one end, and a fusible pellet between said isolating member and said opposite end of said cavity normally supporting said isolating member against the force of said second compression spring with said conductor bar contacting the ends of said electrical leads and being supported thereby away from the end of said isolating member against the force of said first compression spring.

2. The switch of claim 1 wherein said housing is thermally conductive and said fusible pellet is in thermally conductive contact with said housing.

3. The switch of claim 1 including insulating means for electrically insulating said leads from said housing.

4. The switch of claim 1 wherein said compression springs are in axial alignment.

* * * * *